US006662997B1

(12) United States Patent
Smith et al.

(10) Patent No.: US 6,662,997 B1
(45) Date of Patent: Dec. 16, 2003

(54) MAIL RECEPTACLE

(76) Inventors: Diane Smith, 5960 N. Matthew Dr., Ellettsville, IN (US) 47429; Patricia L. New, 5960 N. Matthews Dr., Ellettsville, IN (US) 47429

( * ) Notice: Subject to any disclaimer, the term of this patent is extended or adjusted under 35 U.S.C. 154(b) by 0 days.

(21) Appl. No.: 10/112,225

(22) Filed: Mar. 29, 2002

(51) Int. Cl.[7] ..... B65D 91/00

(52) U.S. Cl. ..... 232/39; 232/24; 232/27; 232/29; 232/30; 248/417

(58) Field of Search ..... 232/17, 39, 20, 232/21, 27, 29, 33, 30, 31, 32, 24; 248/417, 131, 415, 349.1, 125.7; 49/386

(56) References Cited

U.S. PATENT DOCUMENTS

| | | | | | |
|---|---|---|---|---|---|
| 76,864 | A | * | 4/1868 | White | 232/17 |
| 244,227 | A | * | 7/1881 | Ginesi | 232/32 |
| 292,069 | A | * | 1/1884 | Teller | 232/32 |
| 336,052 | A | * | 2/1886 | Jovine | 232/32 |
| 400,026 | A | * | 3/1889 | Wicek | 232/32 |
| 458,273 | A | * | 8/1891 | Scott | 232/21 |
| 934,245 | A | * | 9/1909 | Viezzi | 232/32 |
| 1,058,419 | A | * | 4/1913 | Frediani | 232/53 |
| 1,550,597 | A | * | 8/1925 | Viezzi | 232/32 |
| 1,640,153 | A | * | 8/1927 | Kolstad | 232/19 |
| 1,838,801 | A | * | 12/1931 | Andrews et al. | 232/32 |
| 3,030,058 | A | * | 4/1962 | Rosing | 248/213.2 |
| 3,407,997 | A | * | 10/1968 | Wood et al. | 232/39 |
| 3,874,583 | A | * | 4/1975 | Moll | 232/17 |
| 4,785,960 | A | * | 11/1988 | Belisle | 220/23.83 |
| 4,865,285 | A | * | 9/1989 | Gaggianese | 248/309.4 |
| 4,893,747 | A | * | 1/1990 | Roth | 232/39 |
| 4,955,534 | A | * | 9/1990 | Raible | 232/39 |
| 5,368,226 | A | * | 11/1994 | Franceschino | 232/19 |
| 5,400,958 | A | * | 3/1995 | Walker | 232/39 |
| 5,458,286 | A | * | 10/1995 | Paschal | 232/39 |
| 5,465,902 | A | * | 11/1995 | Hanson | 232/33 |
| 5,597,116 | A | * | 1/1997 | Morris | 232/20 |
| 5,622,343 | A | * | 4/1997 | Morton | 248/131 |
| 5,678,757 | A | * | 10/1997 | Martin | 232/17 |
| 5,699,989 | A | * | 12/1997 | Guthrie | 248/219.2 |
| 5,803,353 | A | * | 9/1998 | Fisher | 232/39 |
| 6,223,982 | B1 | * | 5/2001 | Dunn | 232/39 |

* cited by examiner

*Primary Examiner*—William L. Miller

(57) ABSTRACT

An improved mail receptacle that expands to accommodate a large volume of mail, which volume could include a parcel. To attain this, the mail receptacle has an expandable pouch. In an embodiment, the pouch is configured to be stored in a pouch box, which box is affixed to or integral with the mail compartment. In an embodiment, the mail receptacle has a flexible post. In an embodiment, the mail receptacle has a mounting plate incorporated into the mail compartment; such mounting plate couples the mail receptacle to the post such that the mail compartment can rotate about the post.

4 Claims, 4 Drawing Sheets

MAIL RECEPTACLE

BACKGROUND OF THE INVENTION

1. Field of the Invention

The present invention relates to a mail receptacle for use in connection with parcels. The mail receptacle has particular utility for providing expanding capacity to accommodate mail. The mail receptacle also has particular utility for providing a substantially flexible, rotatable mail receptacle.

2. Description of the Related Art

Mail receptacles for receiving mail delivered to the home are known in the prior art. Generally, these devices fall into two broad categories, wall mounted receptacles and post mounted receptacles. Each of the devices currently comprising the above categories suffers from at least one disadvantage. One disadvantage of both types of typical mailboxes is their inability to receive large or odd-shaped packages. A disadvantage of post-mounted mailboxes is that they are prone to damage as they are frequently hit, either inadvertently by vehicles or deliberately by pranksters. The typical post-mounted mailbox with rigid, unyielding construction is therefore subject to breaking upon impact. Another disadvantage of a typical post-mounted mailbox is that a user may be in harms way to either place or receive mail. Because post-mounted mailboxes must facilitate mail delivery, they frequently open to the street. Therefore, a user of a typical post-mounted mailbox stands in the street to access their mail. Thus improvements to devices for receiving mail are needed. Improved mail receptacles are desirable. A mail receptacle with an expanding mail-holding capacity would be desirable. Furthermore, a post-mounted mail receptacle that could withstand a blow without breaking would be desirable, as would a mail receptacle that could be emptied without standing in front of it.

Mail receptacles designed to withstand a side impact are known in the prior art. For example, U.S. Pat. No. 5,699,989 to Guthrie to discloses a mailbox mounting device that returns to its original position after side impact. However, Guthrie '989 does not disclose a mail receptacle having a flexible construction. Nor does Guthrie '989 disclose a mail receptacle having an expandable construction. Similarly, U.S. Pat. No. 5,622,343 to Morton discloses a mailbox mounting device. Likewise, Morton '343 does not disclose a mail receptacle having a flexible construction, nor does Morton '343 disclose a mail receptacle having an expandable construction.

Further, U.S. Pat. No. 5,458,286 to Paschal discloses a rotatable mailbox mounting assembly. Again, Paschal '286 does not disclose a mail receptacle having a flexible construction, nor does Paschal '286 disclose a mail receptacle having an expandable construction. U.S. Pat. No. 3,407,997 to Wood et al. describes a rotatable mailbox. Yet, Wood et al. '997 does not disclose a mail receptacle having a flexible construction, nor does Wood et al. '997 disclose a mail receptacle having an expandable construction.

U.S. Pat. No. 1,640,153 to Kolstad describes a wall mounted expandable mail chute. However, Kolstad '153 may not be adapted to be, for example, a post-mounted mailbox, as Kolstad '153 requires the described mail chute to be incorporated into a wall. Furthermore, Kolstad '153 does not disclose a mail receptacle having a flexible construction.

U.S. Pat. No. 4,785,960 to Belisle describes a mailbox security bag. Although Belisle '960 describes a mailbag that may hold packages, Belisle '960 does not disclose a somewhat rigid mail receptacle having a flexible construction. Further, Belisle '960 does not disclose a rotatable mail receptacle.

Lastly, U.S. Design Patent No. 443,971 to Carr et al. appears to describe a mailbox having an elaborate hummingbird design. Carr does not appear to describe a mail receptacle having an expandable construction, a flexible construction, or a rotatable construction.

While the above-described devices fulfill their respective, particular objectives and requirements, the aforementioned patents do not describe a mail receptacle having a somewhat rigid yet flexible construction. Moreover, the above-mentioned patents make no provision for a mail receptacle having an expandable construction and a rotatable construction.

Therefore, a need exists for a new and improved mail receptacle that is constructed such that it resists breaking upon impact. Further, a need exists for a mail receptacle having an expandable construction, such that large or odd-sized packages could be accommodated. Still further, a need exists for a mail receptacle having a rotatable construction.

In this regard, the present invention substantially fulfills these needs. In this respect, the mail receptacle according to the present invention substantially departs from the conventional concepts and designs of the prior art, and in doing so provides a mail receptacle primarily developed for the purposes of withstanding impacts without breaking, and providing very large mail holding capacity.

SUMMARY OF THE INVENTION

In view of the foregoing disadvantages inherent in the known types of mail receptacles now present in the prior art, the present invention provides an improved mail receptacle, and overcomes the above-mentioned disadvantages and drawbacks of the prior art. As such, the general purpose of the present invention, which will be described subsequently in greater detail, is to provide a new and improved mail receptacle which has all the advantages of the prior art mentioned heretofore and many novel features that result in a mail receptacle which is not anticipated, rendered obvious, suggested, or even implied by the prior art, either alone or in any combination thereof.

To attain this, the present invention essentially comprises a substantially impact proof mail receptacle. To attain this, the mail receptacle has a mail container mounted upon a substantially flexible post. The post may be constructed of any suitable material, such as, for example, rubber. In an embodiment, the mail container is mounted to the post such that the mail container will rotate about the post upon impact. In an embodiment, the mail container includes a large pouch that may hold a large volume of mail and/or a parcel. The pouch may be held in a pouch box when not in use.

There has thus been outlined, rather broadly, the more important features of the invention in order that the detailed description thereof that follows may be better understood and in order that the present contribution to the art may be better appreciated.

In an embodiment, the mail container may have a pouch box that is integral with the mail container. Alternately, the pouch box may be separately affixed to the mail container. There are, of course, additional features of the invention that will be described hereinafter and which will form the subject matter of the claims attached.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved mail receptacle that has all of the advantages of the prior art mail receptacles and none of the disadvantages.

It is another object of the present invention to provide new and improved mail receptacles that may be easily and efficiently manufactured and marketed. An even further object of the present invention is to provide a new and improved mail receptacle that has a low cost of manufacture with regard to both materials and labor, and which accordingly is then susceptible of low prices of sale to the consuming public, thereby making such mail receptacle economically available to the buying public.

Still another object of the present invention is to provide a new mail receptacle that provides in the apparatuses and methods of the prior art some of the advantages thereof, while simultaneously overcoming some of the disadvantages normally associated therewith.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

Figure 1:
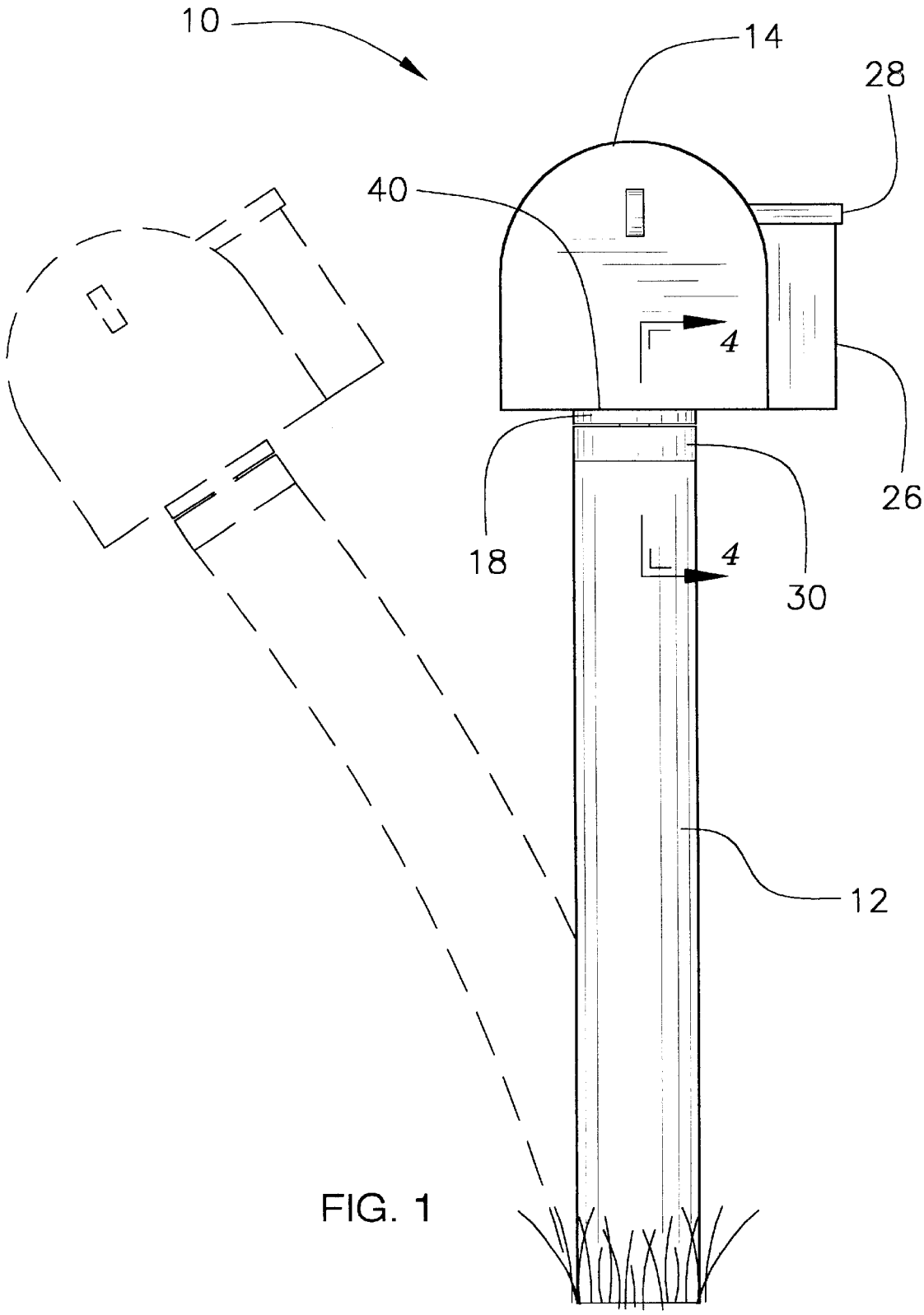
FIG. 1 is a front view of an embodiment of the mail receptacle of the present invention. In this view, the pouch is inside the pouch box.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION OF PREFERRED EMBODIMENTS

Referring now to the drawings, and particularly to FIGS. 1–5, preferred embodiments of the mail receptacle of the present invention are shown and generally designated by the reference numeral.

In FIG. 1, a new and improved mail receptacle is illustrated and will be described as follows. Mail receptacle 10 may initially comprise a typical main compartment 14 used to receive mail. Such a main compartment may include a substantially horizontal floor 40 having a length greater than or equal to its width. For example, the main compartment may be from six to eight inches wide by fifteen to eighteen inches long. Rising from the floor 40 and running along the length of the floor are two opposed substantially parallel sidewalls. That is, the lower portions of the sidewalls may be substantially perpendicular to the floor 40, and therefore parallel to one another as they extend from the floor 40. However, the sidewalls may arc together in such a manner as to form the top of the main compartment 14. Consequently, the sidewalls may be constructed from a single continuous piece of material such as, for example, sheet metal. Or, the main compartment 14 may have a separate, arcuate roof that is arranged concave-down to meet the sidewalls, which sidewalls may remain substantially perpendicular to the floor and parallel to one another through their entire height. The main compartment has a door 32 which may be pivotally mounted to either the sidewalls or the main compartment floor 40. Main compartment floor 40 may be flat, or it may have a corrugated configuration with the corrugations extending lengthwise of the mailbox.

Such a main compartment 14 may be affixed to a rotating mounting plate 18 which mounting plate 18 may then be mounted atop a post 12 and coupled to backing plate 24. Post 12 may include a backing plate collar 30 to provide fastening means for the backing plate 24, as described in further detail below. In an embodiment, post 12 is flexible. For example, post 12 may be made of rubber such that post 12 would resist breakage if hit by, for example, a car or snowplow. Alternately, post 12 could be made of a synthetic material that would be similarly resistant to breakage. As shown in outline in FIG. 1, post 12 is made of a material that could, upon impact, bend from a vertical position without breaking. Further, post 12 could be made from a material that would return to a vertical position unaided. Post 12 could be of a length such that the mailbox would be approximately fifty inches from the ground.

Mail receptacle 10 may include a pouch box 26, such as that shown to the right of main mail compartment in FIG. 1. Such pouch box 26 may be integral with the main compartment 14, or it may be distinct from main compartment 14 yet affixed to main compartment 14. Consequently, pouch box 26 may be of the same material as the mailbox, or it may be of another material. Suitable materials for both include, but are not limited to, metal, plastic, wood, or composite. Pouch box 26 may also include a pouch lid 28, both of which described in further detail below. Pouch box 26 will be of a size and shape to house pouch 16.

Figure 2:
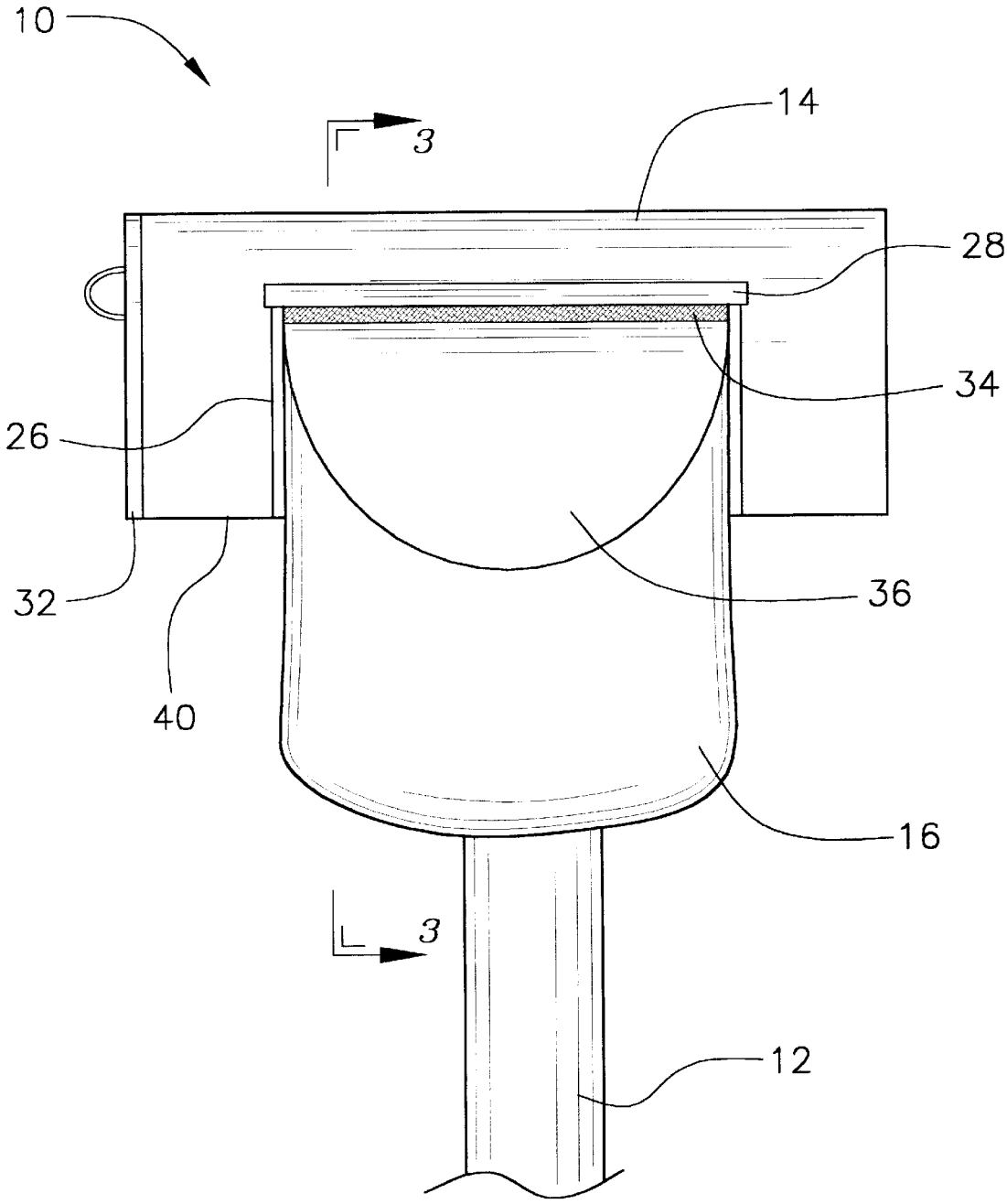
FIG. 2 is a side view of an embodiment of the mail receptacle of the present invention. In this view, the pouch is outside the pouch box.

Turning to FIG. 2, a side view of an embodiment of the present invention is shown. In this side view, mail pouch 16 is shown in its in use position. That is, mail pouch 16 is removed from its pouch box 26. In order to use mail pouch 16, pouch box lid 28 is lifted, and mail pouch 16 is removed from pouch box 26. The top of mail pouch 16 is opened and mail is placed within the pouch. Mail pouch 16 is of a size to accommodate mail that will not fit in main compartment 14. Mail pouch 16 may have a length such that the bottom of the pouch remains well above the ground. Alternately, mail pouch 16 may be long enough to rest on the ground, thus accommodating very large packages.

In FIG. 2, mail pouch 16 is shown having a width approximately equivalent to or less than that of pouch box 26. However, in use mail pouch 16 may be much wider than pouch box 26. In fact mail pouch 16 may even be wider than main mail compartment 14. Mail pouch 16 may include gathering means 34, thus the top of the mail pouch 16 may be pulled together. Gathering means 34 may be elastic or a drawstring or any suitable means to hold the top of the pouch together. Additionally, gathering means 34 may incorporate some method to lock the top of the pouch together such that only the mailbox owner could open the pouch. Further, the mail pouch 16 could also include a pouch flap 36 which could come over the top of the mail pouch 16 and thus keep the pouch contents clean and dry.

Mail pouch 16 may be constructed of any suitable material that is flexible and that has sufficient strength to hold packages. In an embodiment, the mail pouch 16 may be constructed from nylon. However, other materials may be used such as plastic, canvas, silk, or cotton. In an embodiment, mail pouch 16 may be approximately 20 inches wide and 30 inches long.

However, alternate sizes may be desired. For example, if a large number of heavy packages are delivered to a particular address, it may be desired to have a very large mail pouch 16 designed to merely cover the packages as they sit on the ground adjacent the main mail compartment. That is, a very large mail pouch 16 may have a length significantly greater than the distance from the ground to the top of the pouch box 26.

Figure 3:
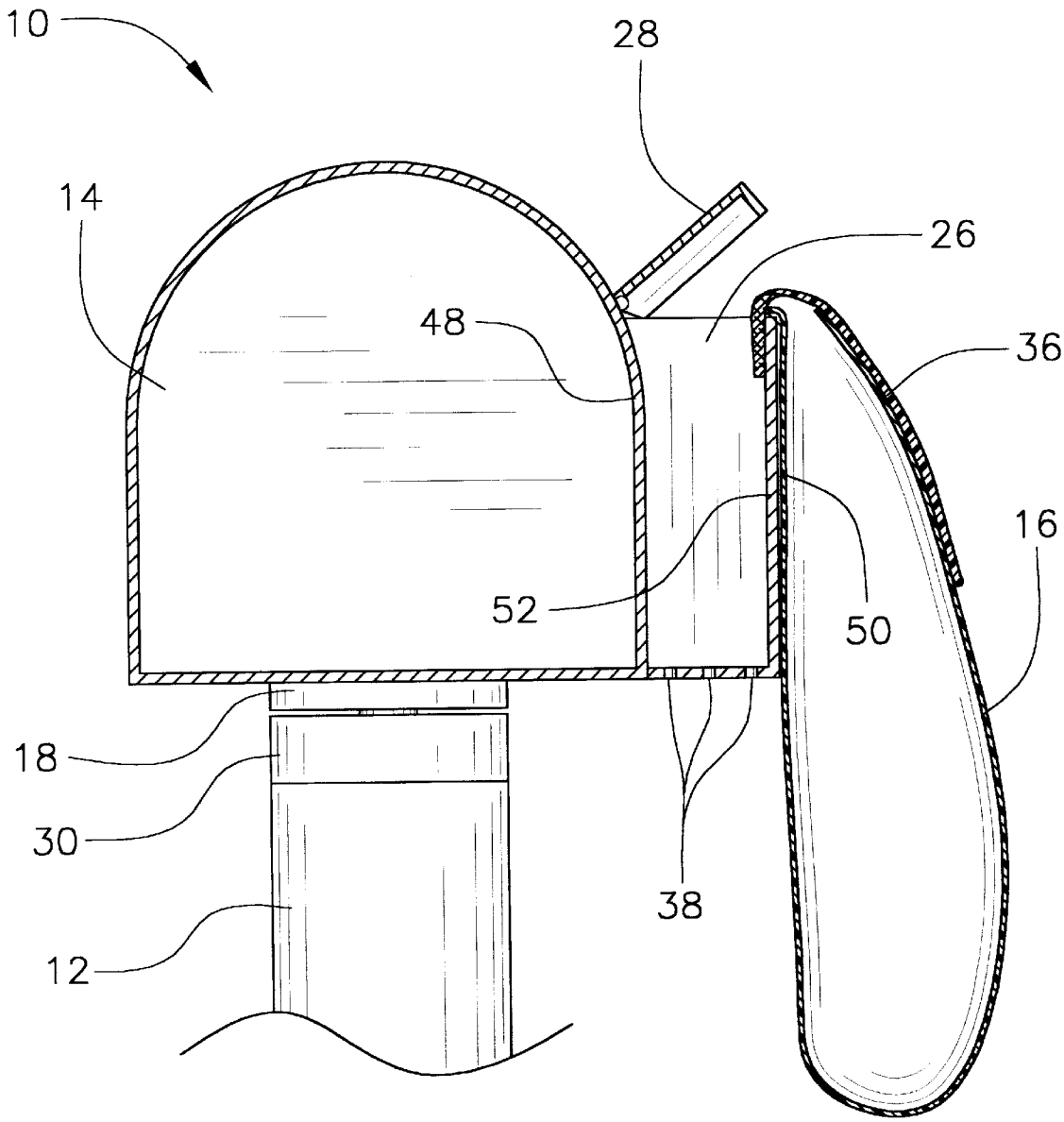
FIG. 3 is a cross-section view of an embodiment of the mail receptacle of the present invention. The cross-section is taken on line 3 of FIG. 2. In this view, the pouch is outside the pouch box.

The mail pouch 16 is affixed to the main compartment. In an embodiment, the mail pouch 16 is affixed to the main compartment 14 via the pouch box 26. The mail pouch 16 may be mounted to the pouch box 26 in a variety of ways, one of which is illustrated in FIG. 3. Mail pouch 16 may be adhered to the front wall of the pouch box 26 as shown. Mail pouch 16 may be affixed to pouch box 26 using any one of various types of fastening means, not shown. For example, mail pouch 16 may be riveted to the pouch box 26, or mail pouch 16 may be heat-molded into the pouch box 26. Pouch flap 36 and mail pouch 16 may be of the same material.

In an embodiment, the back 50 of mail pouch 16 is mounted onto the front wall 52 of the pouch box 26 as shown in FIG. 3. Alternately, the back 50 of mail pouch 16 may be mounted onto the back wall 48 of the pouch box 26, the back wall 48 being that wall closest to or commensurate with the main compartment 14. In such an embodiment, it is preferable that gathering means 34 pull the top of the mail pouch 16 together tightly such that pouch box lid 28 may perform the function of pouch flap 26. For example, back 50 of mail pouch 16 could be affixed to the back 48 of pouch box 26 such that a portion of back 50 extends across the opening of pouch box 26 while mail pouch 16 is being filled. After filling, the top of the mail pouch 16 may be pulled closed using gathering means 34. The pouch box lid 28 may then be closed and locked to the pouch box 26 using a locking mechanism (not shown). In this fashion, the mail pouch 16 could be secured while the pouch is full and suspended from the pouch box 26 because the pouch box lid 28 and pouch box 26 would be locked together. In an alternate embodiment, the back of pouch 50 may be mounted upon a sidewall of the main compartment 14 such that the entire pouch 16 could be placed within main compartment 14. In this embodiment, the mail pouch 16 could be secured closed when a locking mechanism is provided to lock the main compartment door 32 to the mail compartment 14 while the pouch is full and suspended from the main compartment 14.

Another purpose of the present invention is to provide a mail receptacle 10 that can rotate about its post 12. Such a mail receptacle will eliminate the need to stand in a particular place to retrieve mail from the mailbox. Further, such a receptacle may not break when deliberately or accidentally struck. An embodiment of the mechanism to provide rotation is illustrated in FIG. 4 and will be described as follows.

Figure 4:
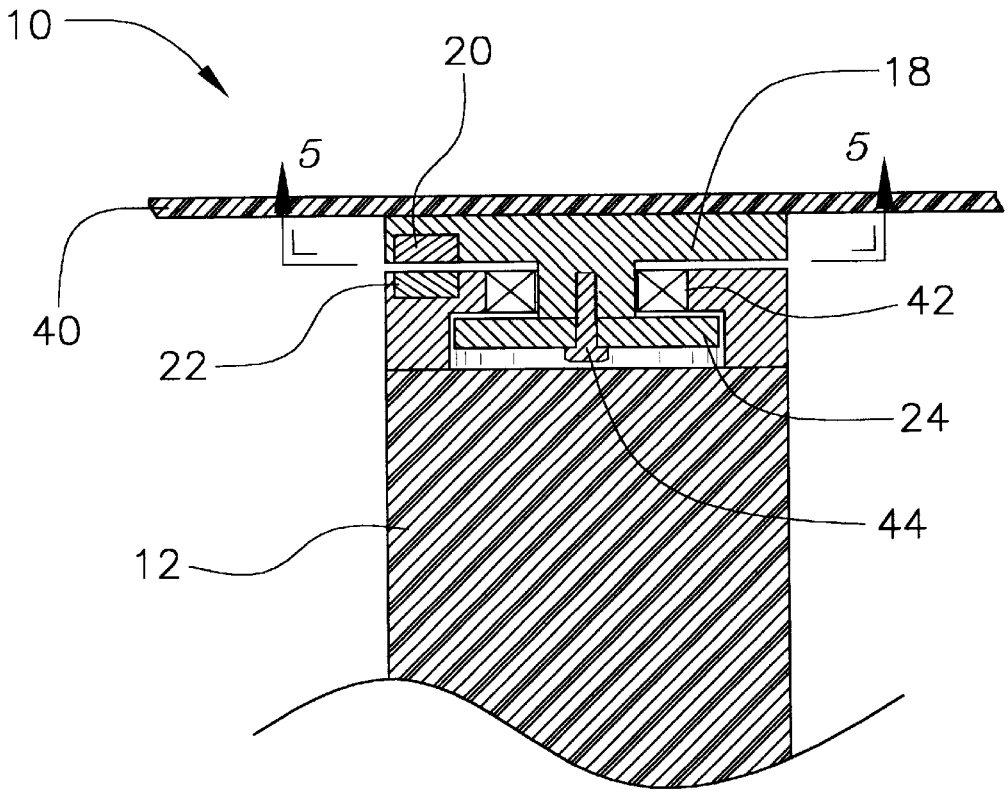
FIG. 4 is a cross-section view of an embodiment of the mail receptacle of the present invention. The cross-section is taken on line 4 of FIG. 1.

FIG. 4 is a cross section taken on line four shown in FIG. 1. Main compartment floor 40 is coupled to a rotating mounting plate 18. Mounting plate 18 may be integral with the floor 40, or it may be separately constructed and affixed to floor 40. For example, mounting plate 18 may be bolted on to the floor 40. Atop post 12 is backing plate 24 to which rotating mounting plate 18 is coupled via bolting means 44. Bolting means 44 may extend through main compartment floor 40. Bearings 42 are configured between rotating mounting plate 18 and backing plate 24. Bearings 42 may be of any configuration that allows 360° rotations in either direction. The backing plate assembly may be coupled to post 12 via backing plate collar 30. Main compartment 14 will rotate about post 12 either upon impact, or when rotated by hand. For example, it may be desirable to rotate the main compartment 14 in order to remove mail without standing in the street. Main compartment 14 may rotate 360° in either direction.

Not only does main compartment 14 rotate on bearings, main compartment 14 may also return to its original position by means of magnets. Negative magnet 20 is incorporated into the rotating mounting plate 18. Positive magnet 22 is affixed to the post. These two magnets are arranged such that they are electrically coupled to each other when the main compartment 14 is facing in its desired mail-receiving orientation.

Figure 5:
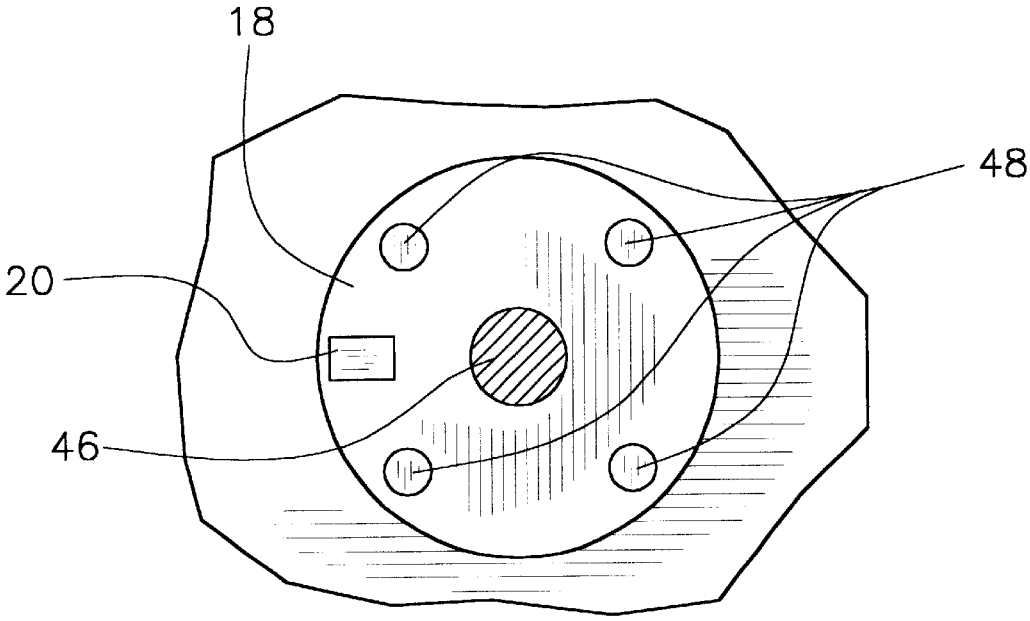
FIG. 5 is a cross-section view of an embodiment of the mail receptacle of the present invention. The cross-section is taken on line 5 of FIG. 4.

FIG. 5 is a cross section taken on line five shown in FIG. 4. Illustrated is rotating mounting plate 18 having incorporated therein negative magnet 20 and positive magnets 48. Negative magnet 20 may be considered an orientation-maintaining magnet, whereas positive magnets 48 may be considered orientation-correcting magnets. That is, when rotated such that the positive magnet 22 and the negative magnet 20 are not coupled, additional positive magnets 48 incorporated into the rotating mounting plate 18 influence the positive magnet 22. That is, positive base magnet 22 acts to repel positive mounting plate magnets 48, and vice versa.

Consequently, when the main compartment 14 is not facing in its desired orientation, oppositional magnetic forces act to rotate the main compartment to its desired orientation. Further, attractive magnetic forces act to keep the main compartment in its desired orientation. Therefore, the configuration of magnets shown is by way of example only. For example, the number and/or positioning of positive magnets 48 may vary. Also, note that all polarities given are by way of example and may be reversed.

In use, it can now be understood that the mail receptacle described herein would provide a substantially unbreakable, expandable mail receptacle. While some preferred embodiments of the mail receptacle have been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, the post could be made of any suitable, flexible material. Also, any suitably impermeable and strong material may be used as a pouch instead of the nylon construction described. And although a pouch box has been described, it should be appreciated that the mail pouch herein described may also be incorporated into a mail receptacle using other means. Furthermore, a wide variety of modifications may be made to the rotating mounting plate and corresponding mounting means without departing from the scope of the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A mail receptacle, comprising:

a flexible post, and a mail compartment, wherein the mail compartment is rotatably coupled to the post and affixed to a mounting plate, wherein the mounting plate comprises magnets, and wherein at least one magnet has positive polarity and at least one magnet has negative polarity.

2. The mail receptacle as recited in claim 1, wherein the mounting plate is coupled to the post.

3. The mail receptacle as recited in claim 2, wherein the mounting plate is configured to rotate with respect to a backing plate.

4. A mail receptacle, comprising:

a main compartment, wherein the main compartment is configured to receive and hold mail;

a post, wherein the post is flexible;

a backing plate, wherein the backing plate is affixed to the post;

a rotating mounting plate, wherein the rotating mounting plate is coupled to the backing plate, and wherein the rotating mounting plate is affixed to the floor of the main compartment;

a pouch box, wherein the pouch box is affixed to the main compartment; and a pouch, wherein the pouch is affixed to the pouch box.

* * * * *